US008983759B2

(12) United States Patent
Smith et al.

(10) Patent No.: US 8,983,759 B2
(45) Date of Patent: Mar. 17, 2015

(54) SYSTEM AND METHOD FOR COMMUNICATING IN A VEHICLE CONSIST

(75) Inventors: Eugene A. Smith, Melbourne, FL (US); Robert Carmen Palanti, Melbourne, FL (US); Robert Edwin Havicon, Jr., Melbourne, FL (US)

(73) Assignee: General Electric Company, Schenectady, NY (US)

( * ) Notice: Subject to any disclaimer, the term of this patent is extended or adjusted under 35 U.S.C. 154(b) by 203 days.

(21) Appl. No.: 13/537,155

(22) Filed: Jun. 29, 2012

(65) Prior Publication Data

US 2014/0005915 A1 Jan. 2, 2014

(51) Int. Cl.
*G08G 1/01* (2006.01)

(52) U.S. Cl.
CPC ..... *G08G 1/01* (2013.01)
USPC ..... 701/117

(58) Field of Classification Search
CPC ..... G08G 1/01
See application file for complete search history.

(56) References Cited

U.S. PATENT DOCUMENTS

| | | | |
|---|---|---|---|
| 5,720,455 | A | 2/1998 | Klemanski et al. |
| 5,738,311 | A | 4/1998 | Fernandez |
| 5,740,547 | A | 4/1998 | Kull et al. |
| 5,785,392 | A | 7/1998 | Hart |
| 5,813,635 | A | 9/1998 | Fernandez |
| 5,820,226 | A | 10/1998 | Hart |
| 5,833,325 | A | 11/1998 | Hart |
| 5,927,822 | A | 7/1999 | Hart |
| 5,934,764 | A | 8/1999 | Dimsa et al. |
| 5,950,967 | A | 9/1999 | Montgomery |
| 5,969,643 | A | 10/1999 | Curtis |
| 5,978,718 | A | 11/1999 | Kull |
| 5,986,577 | A | 11/1999 | Bezos |
| 5,986,579 | A | 11/1999 | Halvorson |
| 5,995,881 | A | 11/1999 | Kull |
| 6,114,974 | A | 9/2000 | Halvorson |
| 6,128,558 | A | 10/2000 | Kernwein |

(Continued)

FOREIGN PATENT DOCUMENTS

| | | | |
|---|---|---|---|
| WO | WO9960735 | A1 | 11/1999 |
| WO | WO2010039680 | A1 | 4/2010 |

(Continued)

OTHER PUBLICATIONS

International Search Report and Written Opinion issued in connection with corresponding PCT Application No. PCT/US2013/044261 dated May 2, 2014.

*Primary Examiner* — John Q Nguyen
*Assistant Examiner* — Michael Kerrigan

(57) ABSTRACT

A method for communicating includes transmitting a command message from a lead vehicle to remote vehicles in a vehicle consist. Reply messages are transmitted from the remote vehicles to the lead vehicle. The reply messages include statuses of the remote vehicles that transmitted the reply messages. The status of a first remote vehicle but not of the second remote vehicle is received at the lead vehicle and the status of a second remote vehicle is received at the first remote vehicle. The status of the second remote vehicle is stored at the first remote vehicle a retry message is transmitted from the lead vehicle to the remote vehicles. The retry message is received at the first remote vehicle and a repeat message is transmitted from the first remote vehicle to the lead vehicle that includes the status of the second remote vehicle.

33 Claims, 5 Drawing Sheets

(56) References Cited

U.S. PATENT DOCUMENTS

| | | | | |
|---|---|---|---|---|
| 6,163,089 | A | 12/2000 | Kull | |
| 6,216,095 | B1 | 4/2001 | Glista | |
| 6,275,165 | B1 | 8/2001 | Bezos | |
| 6,322,025 | B1 | 11/2001 | Colbert et al. | |
| 6,360,998 | B1 | 3/2002 | Halvorson et al. | |
| 6,377,215 | B1 | 4/2002 | Halvorson et al. | |
| 6,708,038 | B1 | 3/2004 | Laguer-Diaz | |
| 6,782,044 | B1 | 8/2004 | Wright et al. | |
| 7,038,597 | B2 * | 5/2006 | Smith | 340/933 |
| 7,236,859 | B2 | 6/2007 | Horst | |
| 7,416,262 | B2 | 8/2008 | Ring | |
| 7,529,201 | B2 | 5/2009 | Aiken | |
| 7,535,865 | B2 | 5/2009 | Aiken | |
| 7,792,089 | B2 | 9/2010 | Aiken | |
| 8,073,582 | B2 | 12/2011 | Kellner | |
| 8,157,218 | B2 | 4/2012 | Riley et al. | |
| 8,428,798 | B2 | 4/2013 | Kull | |
| 2003/0094546 | A1 | 5/2003 | Kellner et al. | |
| 2004/0100938 | A1 | 5/2004 | Aiken | |
| 2004/0114631 | A1 | 6/2004 | Aiken | |
| 2004/0120305 | A1 | 6/2004 | Aiken | |
| 2004/0143374 | A1 | 7/2004 | Horst | |
| 2005/0121971 | A1 | 6/2005 | Ring | |
| 2007/0192668 | A1 | 8/2007 | Hrebek | |
| 2011/0099413 | A1 | 4/2011 | Cooper et al. | |

FOREIGN PATENT DOCUMENTS

| | | | |
|---|---|---|---|
| WO | 20100104641 | A1 | 9/2010 |
| ZA | 200101708 | A | 8/2001 |

* cited by examiner

SYSTEM AND METHOD FOR COMMUNICATING IN A VEHICLE CONSIST

FIELD

Embodiments of the inventive subject matter described herein relate to communications between vehicles in a vehicle consist.

BACKGROUND

Some known vehicle consists include several powered vehicles that generate tractive effort for propelling the vehicle consists along a route. For example, trains may have several locomotives coupled with each other that propel the train along a track. The locomotives may communicate with each other in order to coordinate the tractive efforts and/or braking efforts provided by the locomotives. As one example, locomotives may be provided in a distributed power (DP) arrangement with one locomotive designated as a lead locomotive and other locomotives designated as remote locomotives. The lead locomotive may direct the tractive and braking efforts provided by the remote locomotives during a trip of the consist.

Some known consists use wireless communication between the locomotives for coordinating the tractive and/or braking efforts. For example, a lead locomotive can issue commands to the remote locomotives. The remote locomotives receive the commands and implement the tractive efforts and/or braking efforts directed by the commands. In order to ensure that the remote locomotives receive the commands, the lead locomotive may periodically re-transmit the commands until all of the remote locomotives confirm receipt of the commands by communicating a confirmation message to the lead locomotive.

Due to interference with wireless communications caused by other wireless devices, significant distance between locomotives, travel through tunnels or urban areas, and the like, some confirmation messages may not be received by the lead locomotive. As a result, the lead locomotive may continue to re-send the commands to the remote locomotives on a periodic basis, even if the remote locomotives have received the commands. Some lead locomotives declare a communication error or loss of communication state when all of the remote locomotives do not reply to command messages after a designated number of re-transmissions of the command messages. Such a communication error state alerts the operator of the loss of communication with the remote locomotives and may cause the operator undue concern about the operating state of the remote locomotives and the operator to slow or stop movement until the error can be examined and/or repaired. If the cause of the error state is that the remote locomotives are receiving the command messages but the lead locomotive is not receiving all of the confirmation messages from the remote locomotives, such an communication error state may be unnecessary and consume considerable time during the scheduled travels of the consist.

BRIEF DESCRIPTION

In one embodiment, a method (e.g., for communicating in a vehicle consist) includes transmitting a command message from a lead vehicle in the vehicle consist having two or more remote vehicles coupled with the lead vehicle. The command message includes a directive for controlling one or more operations of the remote vehicles. The method also includes receiving the command message at the remote vehicles and transmitting reply messages to the lead vehicle from the remote vehicles. The reply messages include statuses of the remote vehicles that transmitted the reply messages. The method further includes receiving the status of a first remote vehicle of the two or more remote vehicles at the lead vehicle and receiving the status of a second remote vehicle of the two or more remote vehicles at the first remote vehicle. The status of the second remote vehicle is not received at the lead vehicle. The method also includes storing the status of the second remote vehicle at the first remote vehicle and transmitting a retry message from the lead vehicle to the remote vehicles. The retry message includes an identity of the second remote vehicle. The method further includes receiving the retry message at the first remote vehicle and transmitting a repeat message from the first remote vehicle to the lead vehicle in response to receiving the retry message. The repeat message includes the status of the second remote vehicle.

In another embodiment, another method (e.g., for communicating in a vehicle consist) includes transmitting a command message from a lead vehicle in a vehicle consist having two or more remote vehicles coupled with the lead vehicle. The command message includes a directive for controlling one or more operations of the remote vehicles. The method also includes receiving a first reply message from a first remote vehicle of the remote vehicles in the vehicle consist. The first reply message is transmitted by the first remote vehicle responsive to the command message and including a status of the first remote vehicle. A second reply message is not received from a second remote vehicle of the remote vehicles in the vehicle consist responsive to the command message. The method further includes transmitting a retry message from the lead vehicle to the remote vehicles. The retry message includes an identity of the second remote vehicle. The method also includes receiving a first repeat message from the first remote vehicle in response to the retry message. The first repeat message includes the status of the second remote vehicle.

In another embodiment, another method (e.g., for communicating in a vehicle consist) includes transmitting a command message from a lead vehicle in a vehicle consist having two or more remote vehicles coupled with the lead vehicle. The command message includes a directive for controlling one or more operations of the remote vehicles. The method also includes receiving a first reply message from a first remote vehicle of the two or more remote vehicles in the vehicle consist responsive to the command message. The first reply message includes a status of the first remote vehicle. If a second reply message is not received from a second remote vehicle of the remote vehicles responsive to the command message, then the method also includes transmitting a retry message from the lead vehicle to the remote vehicles (where the retry message includes an identity of the second remote vehicle) and receiving a first repeat message from the first remote vehicle in response to the retry message (where the first repeat message includes the status of the second remote vehicle).

In another embodiment, a method (e.g., for communicating in a vehicle consist) includes receiving a command message from a lead vehicle at a first remote vehicle in the vehicle consist having the lead vehicle, the first remote vehicle, and a second remote vehicle coupled with one another. The command message includes a directive from the lead vehicle for controlling one or more operations of the first remote vehicle and the second remote vehicle. The method also includes transmitting a reply message to the lead vehicle from the first remote vehicle. The reply message includes a first status of the first remote vehicle. The method also includes receiving a second status of the second remote vehicle at the first remote vehicle, storing the second status at the first remote vehicle, and receiving a first retry message transmitted from the lead vehicle at the first remote vehicle. The first retry message includes an identity of the second remote vehicle. The method also includes transmitting a first repeat message from the first remote vehicle to the lead vehicle in response to receiving the first retry message. The first repeat message includes the second status of the second remote vehicle that is stored at the first remote vehicle.

In one embodiment, a system (e.g., a communication system) includes a lead communication unit, first and second remote communication units, and a memory. As used herein, the term "unit" includes a hardware and/or software system that operates to perform one or more functions. For example, a unit may include a computer processor, controller, or other logic-based device that performs operations based on instructions stored on a tangible and non-transitory computer readable storage medium, such as a computer memory. Alternatively, a unit may include a hard-wired device that performs operations based on hard-wired logic of the device. The units shown in the attached figures may represent the hardware that operates based on software or hardwired instructions, the software that directs hardware to perform the operations, or a combination thereof.

The lead communication unit is configured to be disposed onboard a lead vehicle in a vehicle consist having at least first and second remote vehicles coupled with the lead vehicle. The lead communication unit also is configured to transmit a command message to the remote vehicles for controlling one or more operations of the first and second remote vehicles. The first and second remote communication units are configured to be disposed onboard the first and second remote vehicles of the vehicle consist, respectively. The first and second remote communication units are configured to receive the command message and to broadcast first and second reply messages to the lead vehicle that includes first and second statuses of the first and second remote vehicles, respectively. The lead communication unit is configured to receive the first status of the first remote vehicle and the first remote communication unit is configured to receive the second status of the second remote vehicle. The memory is configured to be disposed onboard the first remote vehicle and to store the second status of the second remote vehicle. The lead communication unit is configured to transmit a retry message that includes an identity of the second remote vehicle when the second reply message to the command message is not received at the lead vehicle from the second remote vehicle. The first remote communication unit is configured to receive the retry message and to transmit a repeat message to the lead vehicle in response to receiving the retry message. The repeat message includes the status of the second remote vehicle.

In one another embodiment, a system (e.g., a communication system) includes a lead communication unit and a memory. The lead communication unit is configured to be disposed onboard a lead vehicle in a vehicle consist having two or more remote vehicles coupled with the lead vehicle. The lead communication unit also is configured to transmit a command message having a directive for controlling one or more operations of the remote vehicles and to receive a reply message from a first remote vehicle of the remote vehicles in the vehicle consist. The reply message transmitted by the first remote vehicle is responsive to the command message and including a status of the first remote vehicle. The memory is configured to be disposed onboard the lead vehicle and to store the status of the first remote vehicle. When a second reply message is not received by the lead communication unit from a second remote vehicle of the remote vehicles in the vehicle consist responsive to transmission of the command message, the lead communication unit is configured to transmit a retry message from the lead vehicle to the remote vehicles that includes an identity of the second remote vehicle and to receive a first repeat message from the first remote vehicle in response to the retry message. The first repeat message includes the status of the second remote vehicle.

In another embodiment, a system (e.g., a communication system) includes a first remote communication unit and a memory. The first remote communication unit is configured to be disposed onboard a first remote vehicle of a vehicle consist having a lead vehicle and at least one second remote vehicle coupled with the first remote vehicle. The first remote communication unit is configured to receive a command message from the lead vehicle for controlling one or more operations of the first remote vehicle and the at least one second remote vehicle and to transmit a reply message to the lead vehicle from the first remote vehicle that includes a first status of the first remote vehicle. The memory is configured to be disposed onboard the first remote vehicle. The first remote communication unit is configured to receive a second status of the at least one second remote vehicle that is transmitted by a second remote communication unit responsive to the command message and the memory is configured to store the second status at the first remote vehicle. The first remote communication unit also is configured to receive a first retry message from the lead vehicle that includes an identity of the at least one second remote vehicle and to transmit a first repeat message to the lead vehicle in response to receiving the first retry message. The first repeat message includes the second status of the at least one second remote vehicle that is stored at the first remote vehicle.

BRIEF DESCRIPTION OF THE DRAWINGS

Reference is now made briefly to the accompanying drawings, in which.

DETAILED DESCRIPTION

Figure 1:
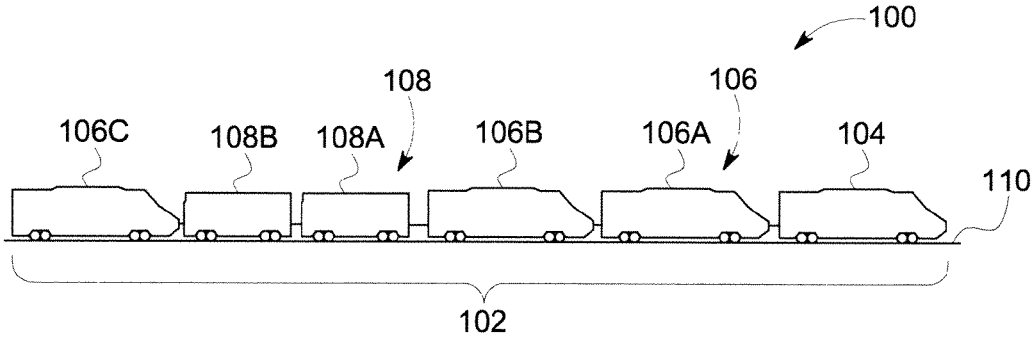
FIG. 1 is a schematic view of one embodiment of a communication system of a vehicle consist.

FIG. 1 is a schematic view of one embodiment of a communication system 100 of a vehicle consist 102. The illustrated vehicle consist 102 includes powered vehicles 104, 106 (e.g., vehicles 104, 106A, 106B, 106C) and non-powered vehicles 108 (e.g., vehicles 108A, 108B) mechanically coupled with each other. By "powered," it is meant that the powered vehicles 104, 106 include propulsion subsystems that act to propel the vehicles 104, 106 such that the vehicles 104, 106 are self-propelled. By "non-powered," it is meant that the vehicles 108 do not include the propulsion subsystems and are not capable of self-propulsion, but may otherwise receive power (e.g., electric energy) for one or more purposes. The powered vehicles 104, 106 are shown as locomotives, the non-powered vehicles 108 are shown as rail cars, and the vehicle consist 102 is shown as a train in the illustrated embodiment. Alternatively, the vehicles 104, 106 may represent other vehicles, such as automobiles, marine vessels, or the like, and the vehicle consist 102 can represent a grouping or coupling of these other vehicles. The number and arrangement of the vehicles 104, 106 in the vehicle consist 102 are provided as one example and are not intended as limitations on all embodiments of the inventive subject matter described herein.

The powered vehicles 104, 106 can be arranged in a distributed power (DP) arrangement. For example, the powered vehicles 104, 106 can include a lead vehicle 104 that issues command messages to the other powered vehicles 106A, 106B, 106C which are referred to herein as remote vehicles. The designations "lead" and "remote" are not intended to denote spatial locations of the powered vehicles 104, 106 in the vehicle consist 102, but instead are used to indicate which powered vehicle 104, 106 is transmitting command messages and which powered vehicles 104, 106 are being remotely controlled using the command messages. For example, the lead vehicle 104 may or may not be disposed at the front end of the vehicle consist 102 (e.g., along a direction of travel of the vehicle consist 102). Additionally, the remote vehicles 106A-C need not be separated from the lead vehicle 104. For example, a remote vehicle 106A-C may be directly coupled with the lead vehicle 104 or may be separated from the lead vehicle 104 by one or more other remote vehicles 106A-C and/or non-powered vehicles 108.

The command messages may include directives that direct operations of the remote vehicles. These directives can include propulsion commands that direct propulsion subsystems of the remote vehicles to move at a designated speed and/or power level, brake commands that direct the remote vehicles to apply brakes at a designated level, and/or other commands. The lead vehicle 104 issues the command messages to coordinate the tractive efforts and/or braking efforts provided by the powered vehicles 104, 106 in order to propel the vehicle consist 102 along a route 110, such as a track, road, waterway, or the like.

The command messages can be communicated using the communication system 100, as described below. In one embodiment, the command messages are wirelessly communicated using the communication system 100. Due to various impediments to wireless communication, some command messages may not be received by one or more of the remote vehicles 106. In order to confirm whether a command message is received by the remote vehicles 106, the remote vehicles 106 that receive the command message respond by transmitting a reply message. For example, responsive to receiving the command message from the lead vehicle 104, a remote vehicle 106 may transmit a reply message.

The reply message notifies the lead vehicle 104 that the remote vehicle 106 received the command message from the lead vehicle 104. The reply message can include a status and an identity of the remote vehicle 106 that transmits the reply message. The status can include data in the reply message (e.g., one or more bits or bytes) that represent one or more current operational states of the remote vehicle 106, such as a currently implemented tractive effort, a currently implemented braking effort, one or more operational errors of the remote vehicle 106, or the like. The identity can include data in the reply message that represents which remote vehicle 106 transmitted the reply message. For example, the different remote vehicles 106 may be associated with distinct identifiers (e.g., numeric and/or alphanumeric sequences or codes) that can be used by determine which remote vehicle 106 sent the reply message.

The reply messages may be broadcast by the remote vehicles 106 such that the lead vehicle 104 and/or one or more of the other remote vehicles 106 receive the reply messages. For example, the remote vehicle 106C may transmit a reply message that is received by the lead vehicle 104, the remote vehicle 106A and/or 106B. The remote vehicles 106 that receive reply messages from one or more other remote vehicles 106 may store (e.g., record, log, or otherwise retain in an onboard memory) the status and identity of the other remote vehicles 106. With respect to the preceding example, one or more of the remote vehicles 106A and/or 106B may locally store the status and identity of the remote vehicle 106C, as described in more detail below.

In one embodiment, subsequent to transmitting a command message, the lead vehicle 104 receives one or more reply messages from the remote vehicles 106. The lead vehicle 104 determines which remote vehicles 106 that the lead vehicle 104 did not receive a reply message from. For example, the lead vehicle 104 may transmit a command message and receive reply messages from the remote vehicles 106A and 106C, but not from the remote vehicle 106B. The lead vehicle 104 can examine the identities in the reply messages that are received at the lead vehicle 104 in order to determine which remote vehicles 106 did not have reply messages received at the lead vehicle 104. The lead vehicle 104 can compare the identities in the received reply messages with a list, table, or other memory structure that includes the identities of the remote vehicles 106 in the vehicle consist 102 to determine which remote vehicles 106 did not have reply messages received by the lead vehicle 104.

When the lead vehicle 104 determines that reply messages are not received from one or more remote vehicles 106, the lead vehicle 104 transmits a retry message to the remote vehicles 106. The retry message can include the directive of the command message and one or more missing reply identifiers. The missing reply identifiers can include the identities of the one or more remote vehicles 106 that did not have reply messages received at the lead vehicle 104. For example, if the lead vehicle 104 did not receive a reply message from the remote vehicle 106B, then the retry message may include the identity of the remote vehicle 106B.

The retry message is received by one or more of the remote vehicles 106. The remote vehicles 106 that receive the retry message can examine the retry message to determine if the one or more missing reply identifiers that are included in the retry message correspond to the identity and associated status of another remote vehicle 106 that is stored onboard the remote vehicle 106 that received the retry message. For example, if a first remote vehicle 106A stores the identity and status of the second and third remote vehicles 106B, 106C, and the lead vehicle 104 transmits a reply message including a missing reply identifier that identifies the second remote vehicle 106B, then the first remote vehicle 106A may determine that the lead vehicle 104 did not receive the reply message from the second remote vehicle 106B. The first remote vehicle 106A can then transmit the stored identity and status of the second remote vehicle 106B to the lead vehicle 104 in a repeat message. The repeat message is a message sent by one remote vehicle 106 that includes the identity and status of another remote vehicle 106.

In one embodiment, the lead and remote vehicles 104, 106 are assigned non-overlapping time slots during which the vehicles 104, 106 are allowed to transmit messages. For example, the lead vehicle 104 may be assigned a periodically repeating first time slot that occurs over a first time period, the first remote vehicle 106A is assigned a periodically repeating second time slot that occurs over a subsequent, second time period, the second remote vehicle 106B can be assigned a periodically repeating third time slot that occurs over a subsequent, third time slot, and so on. The vehicles 104, 106 may only transmit messages during the time slot assigned to each vehicle 104, 106. When a remote vehicle 106 transmits the status of another remote vehicle 106 in response to receiving a retry message from the lead vehicle 104, the remote vehicle 106 may transmit during its assigned time slot the status of the other remote vehicle 106 (whose status was stored onboard the remote vehicle 106 that transmits the status to the lead vehicle 104).

If the lead vehicle 104 receives the identity and status of the second remote vehicle 106B from the transmission from the first remote vehicle 106A, then the lead vehicle 104 may remove the second remote vehicle 106B from the memory structure on the lead vehicle 104 that records which remote vehicles 106 that the lead vehicle 104 has not yet received reply messages since the command message was sent. The lead vehicle 104 may repeatedly transmit retry messages following the transmission of the command message until the lead vehicle 104 receives reply messages or relayed messages from all the remote vehicles 106 in the vehicle consist 102 in one embodiment. Alternatively, the lead vehicle 104 may repeatedly transmit the retry messages following transmission of the command message until the lead vehicle 104 receives reply messages or relayed messages from at least a previously designated number, fraction, or percentage of the total number of remote vehicles 104 in the vehicle consist 102.

In one embodiment, the lead vehicle 104 may transmit the retry message only a previously designated number of times before declaring a communication error. When a communication error occurs, the vehicle consist 102 may enter a communication error state and alert the operator of the lead vehicle 104 that communication has been lost with one or more remote vehicles 106. In response to this loss of communication alert, the operator may elect to slow or stop movement of the vehicle consist 102. Alternatively, the lead vehicle 104 may issue a new command message to the remote vehicles 106 when the communication error is declared.

Figure 2A:
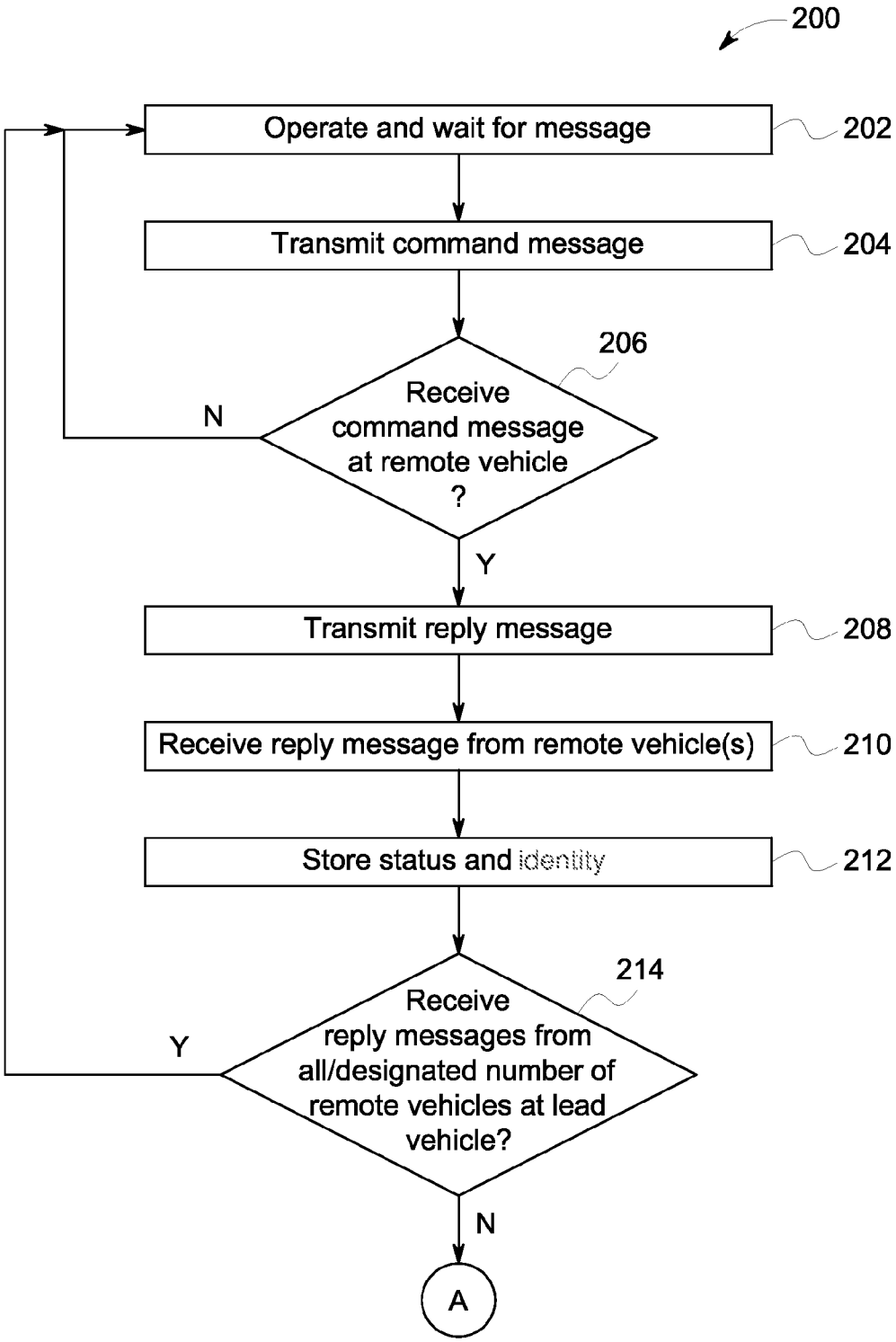
FIGS. 2A and 2B illustrate a flowchart of one embodiment of a method of communicating in the vehicle consist shown in FIG. 1.
Figure 2B:
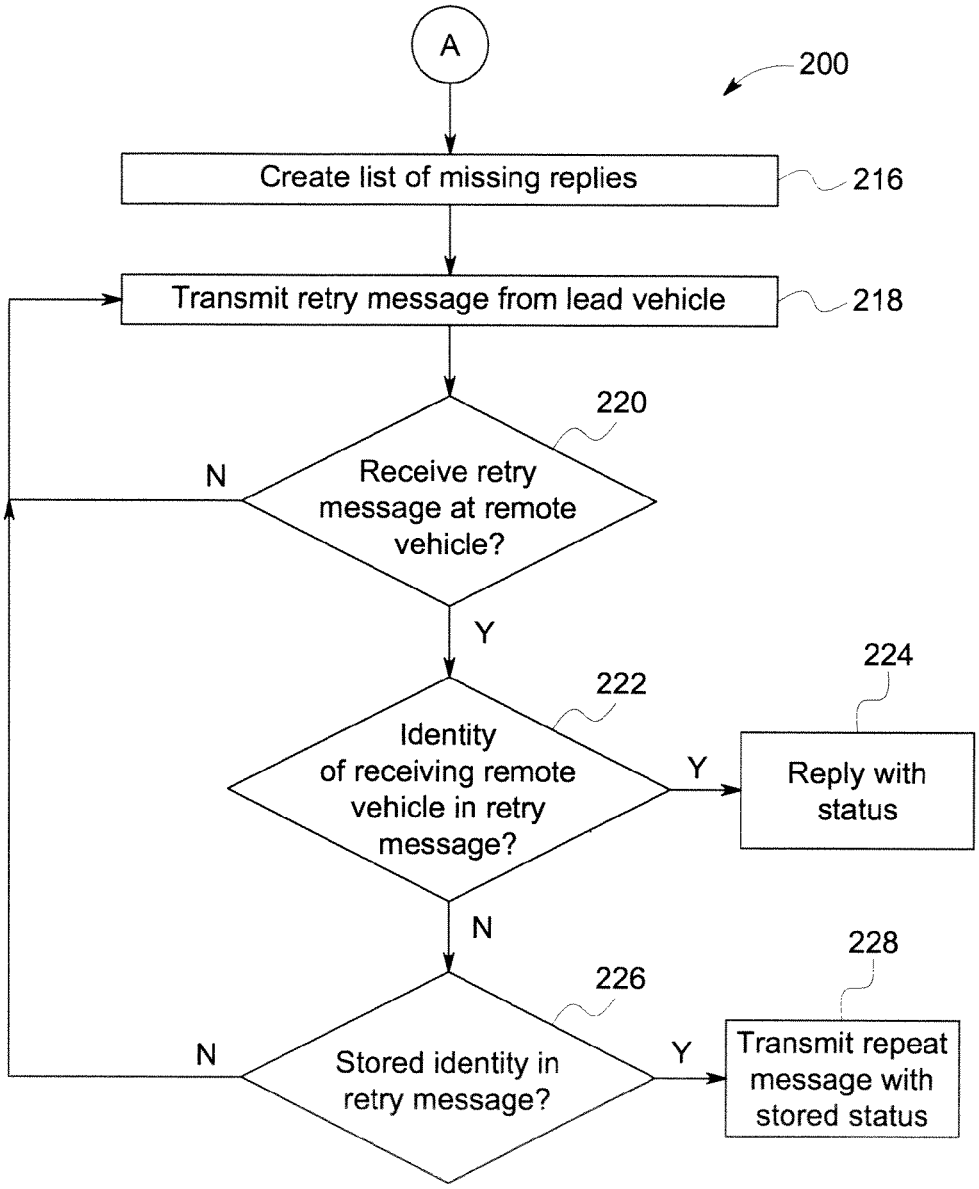

FIGS. 2A and 2B illustrate a flowchart of one embodiment of a method 200 of communicating in the vehicle consist 102 shown in FIG. 1. The method 200 may be used in conjunction with one or more embodiments of the communication system 100 shown in FIG. 1. For example, the method 200 may be used to communicate command messages from the lead vehicle 104 (shown in FIG. 1) to the remote vehicles 106 (shown in FIG. 1) and to handle the re-transmission of commands and/or replies to ensure that all or at least a designated number of remote vehicles 106 receive the command messages. While the method 200 is described in connection with the vehicle consist 102 and communication system 100 shown in FIG. 1, alternatively, the method 200 may be used with another vehicle consist 102 and/or communication system 100.

Figure 3:
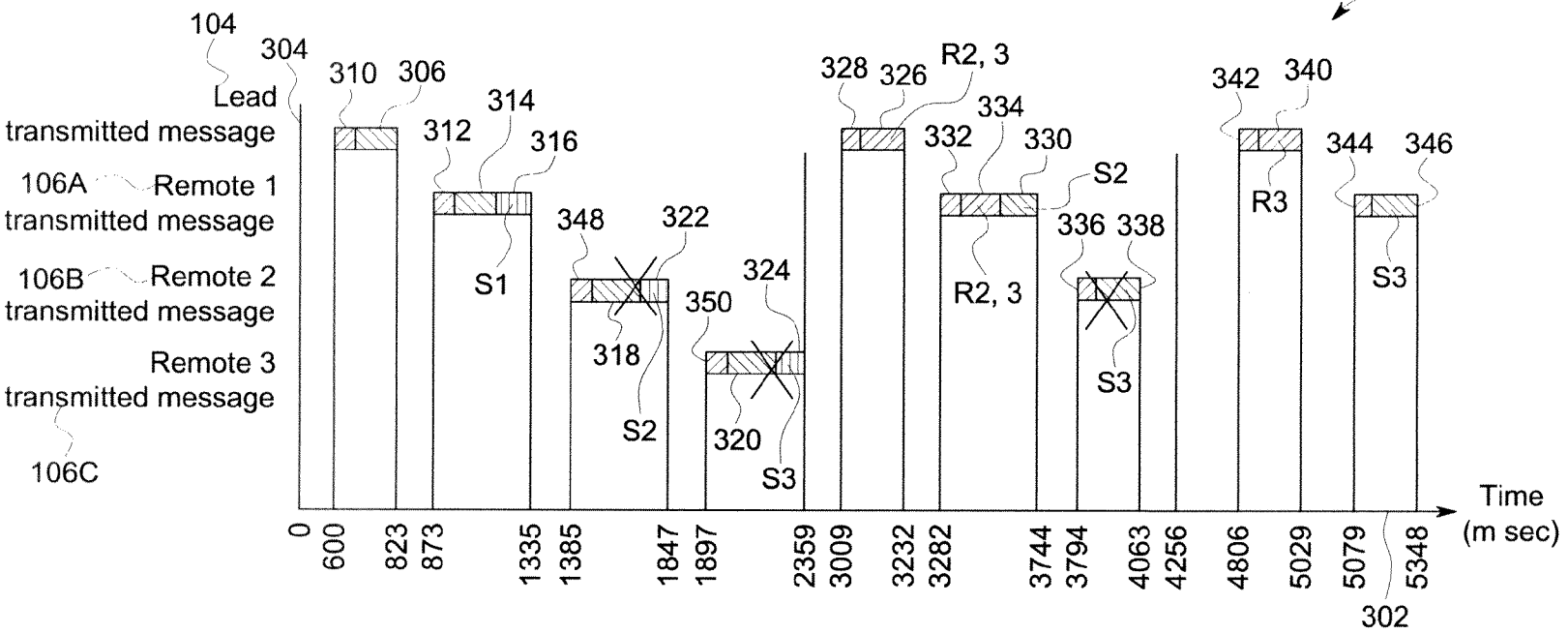
FIG. 3 illustrates an example of a timing diagram that is used to demonstrate one example of the method and use of the communication system shown in FIG. 1.

With continued reference to the method 200 shown in FIGS. 2A and 2B, FIG. 3 illustrates an example of a timing diagram 300 that is used to demonstrate one example of the method 200 and use of the communication system 100. The timing diagram 300 is shown alongside a horizontal axis 302 that is representative of time. The units and values of time shown for the horizontal axis 302 are provided merely as examples and are not intended to be limiting on all embodiments of the inventive subject matter described herein. A vertical axis 304 represents the different powered vehicles 104, 106 of the vehicle consist 100. For example, the events shown to the right of the corresponding vehicle 104, 106 in FIG. 3 occur at the time periods indicated by the horizontal axis 302. While the description herein focuses only on the lead vehicle 104 and the first, second, and third remote vehicles 106A, 106B, 106C, the description may apply to a smaller or larger number of remote vehicles 106.

With respect to the method 200 shown in FIG. 2A, at 202, the powered vehicles 104, 106 continue to operate to propel the vehicle consist 102 based on existing or previously communicated command message. For example, the remote vehicles 106 may continue to operate to propel the vehicle consist 102 based on a previously issue directive sent from the lead vehicle 104.

At 204 (shown in FIG. 2A), a command message 306 (shown in FIG. 3) is transmitted by the lead vehicle 104 to the remote vehicles 106. As described above, the command message 306 may include a directive to the remote vehicles 106 to change tractive efforts and/or braking efforts supplied by the remote vehicles 106. In the embodiment shown in FIG. 3, a communication unit (e.g., communication unit 410 shown in FIG. 4) onboard the lead vehicle 104 is activated during a first activation time period 310 and transmits the command message 306.

With respect to the method 200 shown in FIG. 2A, at 206, a determination is made as to whether the command message 306 is received at a remote vehicle 106. For example, the remote vehicles 106 may determine whether the command message 306 transmitted from the lead vehicle 104 is received. The remote vehicles 106 may determine that the command message 306 is received when the command message 306 is successfully received by the remote vehicles 106 (e.g., the entire command message 306 or at least enough of the command message 306 is received to permit the remote vehicle 106 to follow the directive contained in the command message 306). As a result, flow of the method 200 can proceed to 208. If no command message 306 is received or an insufficient amount of the command message 306 is received for the remote vehicle 106 to be able to understand and implement the directive contained in the command message 306, then the remote vehicles 106 may determine that no command message 306 is received. As a result, flow of the method 200 may return to 202. For example, the remote vehicles 106 may continue to operate and wait for a new command message 306 from the lead vehicle 104.

At 208 (shown in FIG. 2A), a reply message 316 (shown in FIG. 3) is transmitted by the remote vehicles 106 that received the command message 306. As described above, the reply message 316 can include an identity of the remote vehicle 106 that is transmitting the reply message 316 and a status of the remote vehicle 106. Additionally, in one embodiment, the remote vehicle 106 may re-transmit the command message 306 that is received from the lead vehicle 104 as a re-transmitted command message 314 (shown in FIG. 3). The remote vehicles 106 may re-transmit the command message 306 in order to relay the command message 306 from the lead vehicle 104 among the remote vehicles 106 distributed along the length of the vehicle consist 102. In the illustrated example, the first remote vehicle 106A can include a communication unit (e.g., communication unit 410 shown in FIG. 4) that is activated during an activation time period 312 (shown in FIG. 3) and then communicates the re-transmitted command message 314 and the reply message 316 after receiving the command message 306. The designation "S1" in the reply message 316 shown in FIG. 3 represents the status and identifier of the reply message 316 sent by the first remote vehicle 106A. Alternatively, the first remote vehicle 106A may not transmit the re-transmitted command message 314.

At 210 (shown in FIG. 2A), the lead vehicle 104 receives the reply message 316 from one or more of the remote vehicles 106. For example, the communication unit 410 of the lead vehicle 104 can determine whether reply messages 316 sent by one or more of the remote vehicles 106 has been received during a designated time period following transmission of the command message 306. The lead vehicle 104 can examine reply messages 316 that are received from the remote vehicles 106 and extract the identifiers from the received reply messages 316 (or, if the lead vehicle 104 does not detect receipt of any reply messages 316 during the designated time period, then the lead vehicle 104 may determine that no reply messages 316 have been received). The lead vehicle 104 can compare the extracted identities to a list, table, database, or other memory structure stored onboard the lead vehicle 104 (e.g., in a memory 412 shown in FIG. 4) and determine which remote vehicles 106 are not identified by the received reply messages 316.

With respect to the example shown in FIG. 3, each of the second and third remote vehicles 106B, 106C that received the command message 306 from the lead vehicle 104 activated respective communication units 410 (shown in FIG. 4) of the remote vehicles 106B, 106C during activation time periods 348, 350. These communication units 410 re-transmit the command message 306 from the lead vehicle 104 as re-transmitted command messages 318, 320 and transmit reply messages 322, 324. The reply messages 322, 324 shown in FIG. 3 include designations "S2" and "S3" that represent the status and identity of each of the respective second and third remote vehicles 106B, 106C.

In the illustrated example of FIG. 3, the reply message 316 sent by the first remote vehicle 106A is received by the lead vehicle 104, but the reply messages 322, 324 sent by the second and third remote vehicles 106B, 106C, respectively, are not received by the lead vehicle 104, as indicated by the "X" shown over each of the reply messages 322, 324. As a result, at 210, the lead vehicle 104 determines that the reply message 316 from the first remote vehicle 106A is received, but not the reply messages 322, 324 from the second and third remote vehicles 106B, 106C. Consequently, the status of the first remote vehicle 106A is acquired by the lead vehicle 104, but not the statuses of the second or third remote vehicles 106B, 106C.

The flow of the method 200 shown in FIG. 2A may then proceed to 212, where the status and identity of the first remote vehicle 106A is stored. For example, the status and identity of the first remote vehicle 106A may be stored in an onboard memory (e.g., the memory 412) of the lead vehicle 104. Because the reply messages 322, 324 from the second and third remote vehicles 106B, 106C are not received by the lead vehicle 104, the statuses of the second and third remote vehicles 106B, 106C are not stored or recorded by the lead vehicle 104.

In one embodiment, the reply messages 316, 322, 324 are broadcast by the remote vehicles 106 such that one or more of the other remote vehicles 106 receive the reply message 316, 322, 324 that is transmitted in response to the command message 306. For example, instead of transmitting the reply message 316, 322, 324 so that only the lead vehicle 104 can receive the reply message 316, 322, 324, the remote vehicles 106 may transmit the reply messages 316, 322, 324 so that other remote vehicles 106 can receive the reply messages 316, 322, 324. A remote vehicle 106 that receives the reply message 316, 322, 324 of another remote vehicle 106 also may store the status and identity contained in the reply message 316, 322, 324. For example, the first remote vehicle 106A can receive the reply messages 322, 324 broadcast by the second and/or third remote vehicles 106B, 106C, the second remote vehicle 106B can receive the reply messages 316, 324 broadcast by the first and/or third remote vehicles 106A, 106C, and/or the third remote vehicle 106C can receive the reply messages 316, 322 broadcast by the first and/or second remote vehicles 106A, 106B. The remote vehicles 106 that receive reply messages 316, 322, 324 transmitted by other remote vehicles 106 can store the statuses and identities included in the received reply messages 316, 322, 324. For example, the remote vehicles 106 can locally store the statuses and identities of the other remote vehicles 106 in the memory 412 that is onboard the remote vehicles 106.

At 214, a determination is made as to whether reply messages 316, 322, 324 are received by the lead vehicle 104 from all of the remote vehicles 106. If the reply messages 316, 322, 324 are received from all of the remote vehicles 106, then the lead vehicle 104 has the status and identities of the remote vehicles 106 and may not need to re-transmit the command message 306. As a result, flow of the method 200 can return to 202. On the other hand, if the reply messages 316, 322, 324 are not received from all of the remote vehicles 106, then the lead vehicle 104 may not have confirmation that all of the remote vehicles 106 received the command message 306. The lead vehicle 104 may need to re-transmit the command message 306 or at least the directive contained in the command message 306. As a result, flow of the method 200 continues to 216 in FIG. 2B.

Alternatively, a determination can be made at 214 as to whether reply messages 316, 322, 324 are received at the lead vehicle 104 from at least a designated number, fraction, or percentage of the remote vehicles 106, but not necessarily all of the remote vehicles 106. For example, for one or more command messages 306, the lead vehicle 104 may only need a designated number of and/or certain ones of the remote vehicles 106 to receive the command message 306, but not all of the remote vehicles 106. If the reply messages 316, 322, 324 are received from at least the designated number of the remote vehicles 106, then the lead vehicle 104 has the status and identities of the remote vehicles 106 and may not need to re-transmit the command message 306. As a result, flow of the method 200 can return to 202. On the other hand, if the reply messages 316, 322, 324 are not received from at least the designated number of remote vehicles 106, then the lead vehicle 104 may not have confirmation that a sufficient number of the remote vehicles 106 received the command message 306. The lead vehicle 104 may need to re-transmit the command message 306 or at least the directive contained in the command message 306. As a result, flow of the method 200 continues to 216 in FIG. 2B.

At 216, a list is created of the remote vehicles 106 from which the lead vehicle 104 did not receive reply messages 316, 322, 324 in response to the command message 306. The term "list" can include a sequence, table, database, or other memory structure that organizes information for later retrieval and/or updating. In one embodiment, the lead vehicle 104 compares the identities of the remote vehicles 106 from which the lead vehicle 104 received reply messages 316, 322, 324 to a list of the identities of the remote vehicles 104 in the vehicle consist 102. Based on this comparison, the lead vehicle 104 can determine which remote vehicles 106 have not transmitted reply messages 316, 322, 324 or which remote vehicles 106 that the lead vehicle 104 has not received the reply message 316, 322, 324. These remote vehicles 106 can be referred to as "missing remote vehicles 106." The list of missing remote vehicles 106 can be created and stored onboard the lead vehicle 104, such as on the memory 412 of the lead vehicle 104. Alternatively, the list may be created and/or stored at an off-board location (e.g., a dispatch or other facility) and communicated to the lead vehicle 104. In the example shown in FIG. 3, the lead vehicle 104 creates a list having the identities of the second and third remote vehicles 106B, 106C, as the lead vehicle 104 has not received a reply message 316, 322, 324 from the second or third remote vehicles 106B, 106C.

At 218 (shown in FIG. 2B), a retry message is transmitted from the lead vehicle 104. As described above, the retry message can be the same as or similar to the command message 306. For example, the retry message can include the directive that previously was transmitted in the command message 306. The lead vehicle 104 transmits the retry message due to the failure of one or more (or more than a designated number) of the remote vehicles 106 to respond to the previously sent command message 306.

As shown in FIG. 3, a retry message 326 can be transmitted by the lead vehicle 104, such as by the communication unit 410 of the lead vehicle 104. The communication unit 410 may be activated during an activation time period 328 and then the communication unit 410 may wirelessly transmit the retry message 326 and/or transmit the retry message 326 through one or more wired connections. In one embodiment, the retry message 326 includes the directive previously sent in the command message 306 and also includes the identities of one or more of the missing remote vehicles 106. For example, the retry message 326 can include the identities of the remote vehicles 106 from which a reply message 316, 322, 324 was not received responsive to the previous transmission of the command message 306. The designation "R2, 3" in the retry message 326 in FIG. 3 indicates that the identities of the second and third remote vehicles 106B, 106C are included in the retry message 326. These identities can be included in the retry message 326 so as to notify the remote vehicles 106 that the lead vehicle 104 has not received reply messages 316, 322, 324 from the remote vehicles 106 associated with the identities.

At 220 (shown in FIG. 2), a determination is made as to whether the retry message 326 is received at the remote vehicles 106. For example, the communication units 410 of the remote vehicles 106 may receive the retry message 326 from the lead vehicle 106. Alternatively, the communication units 410 of the remote vehicles 106 may determine that the retry message 326 is not received if no retry message 326 is received within a designated time period.

If the retry message 326 is received at a remote vehicle 106, then the remote vehicle 106 can examine the retry message 326 to determine if the remote vehicle 106 can provide the lead vehicle 104 with the status and identity of one or more of the remote vehicles 106 from which the lead vehicle 104 did not receive a reply message 316, 322, 324. As a result, flow of the method 200 may continue to 222. Otherwise, the method 200 may return to 218 if the retry message 326 is not received at the remote vehicle 106. For example, the lead vehicle 104 can re-send the retry message 326 after a designated time period of sending a previous retry message 326.

A remote vehicle 106 that receives the retry message 326 (e.g., a "receiving remote vehicle 106") examines the identities of the missing remote vehicles 106 included in the retry message 326. The receiving remote vehicle 106 can extract the identities of the missing remote vehicles 106 included in the retry message 326 to determine which of remote vehicles 106 that the lead vehicle 104 does not have the status. The receiving remote vehicle 106 can compare the identities of the missing remote vehicles 106 in the retry message 326 and compare these identities to the identities of the remote vehicles 106 that are stored by the receiving remote vehicle 106. For example, the receiving remote vehicle 106 can compare the identities in the retry message 326 with the identities stored in the memory 412 of the receiving remote vehicle 106. As described above, the identities stored in the memory 412 can include the identities of the remote vehicles 106 whose reply messages 316 were received by the receiving remote vehicle 106.

At 222, a determination is made as to whether a remote vehicle 106 that receives the retry message 326 is associated with an identity of a missing remote vehicle 106 included in the retry message 326. With respect to the example of FIG. 3, if the second or third remote vehicles 106B, 106C receive the retry message 326 with the identity of the second or third remote vehicle 106B, 106C, then the second or third remote vehicle 106B, 106C may determine that the remote vehicle 106B or 106C can respond with a status of the vehicle 106B or 106C. As a result, flow of the method 220 may continue to 224. On the other hand, if the statuses of the missing remote vehicles 106 in the retry message 326 do not match the identity of the remote vehicle 106 that receives the retry message 326, then the remote vehicle 106 may not respond with the status of the remote vehicle 106. As a result, flow of the method 200 may continue to 226.

At 224, the remote vehicle 106 that received the retry message 326 and that has the identity of the receiving remote vehicle 106 as a missing remote vehicle 106 can transmit a reply message to the lead vehicle 104. This reply message can include the identity and status of the receiving remote vehicle 106, similar to the reply message 316 described above.

At 226, a determination is made as to whether one or more of the identities of the missing remote vehicles 106 that are included in the retry message 326 match the identities stored in the memory 412 of the receiving remote vehicle 106. For example, in addition to or in place of determining whether the identity of the receiving remote vehicle 106 matches the identities of the missing remote vehicles 106 in the retry message 326, the receiving remote vehicle 106 may determine whether any of the statuses and identities stored onboard the receiving remote vehicle 106 match the identities in the retry message 326. As described above, the receiving remote vehicle 106 may locally store identities and statuses of other remote vehicles 106 based on reply messages 316, 322, 324 that are received by the receiving remote vehicle 106. If the identities of the missing remote vehicles 106 in the retry message 326 match the stored identities, then the receiving remote vehicle 106 may respond with the missing statuses and identities. As a result, flow of the method 200 may continue to 228. On the other hand, if the identifies of the missing remote vehicles 106 in the retry message 326 do not match the stored identifies, then the receiving remote vehicle 106 may not respond to the retry message 326. As a result, flow of the method 200 may return to 218. For example, the communication unit 410 of the remote vehicle 106 may wait for additional retry messages 326 to be sent by the lead vehicle 104. Alternatively or additionally, flow of the method 200 may return to 202 to wait for additional command messages 306 from the lead vehicle 104 or to 210 to wait for the receipt of reply messages 316, 322, 324 from other remote vehicles 106.

At 228, the receiving remote vehicle 106 transmits a repeat message to the lead vehicle 104 that includes the status and identity of at least one of the remote vehicles 106 identified by the retry message 326. With respect to the example shown in FIG. 3, the first remote vehicle 106A may receive the retry message 326 that includes the identities of the missing remote vehicles 106B, 106C. The first remote vehicle 106A compares these identities to the identities stored onboard the first remote vehicle 106A and determines that the first remote vehicle 106A has stored the statuses of the second and third remote vehicles 106B, 106C (based on previously receiving the reply messages 322, 324 from the second and third remote vehicles 106B, 106C, as described above). In response, the first remote vehicle 106A transmits a repeat message to the lead vehicle 104 that includes the status of the second and/or third remote vehicle 106B, 106C.

For example, as shown in FIG. 3, during an activation time period 332, the communication unit 410 of the first remote vehicle 106A turns on or is otherwise activated. The communication unit 410 of the first remote vehicle 106A receives the retry message 326 from the lead vehicle 106A. The first remote vehicle 106A then re-transmits the lead retry message 334 and transmits a repeat message 330 to the lead vehicle 104 that includes the status of the second remote vehicle 106B (as shown by the designation "S2" in FIG. 3).

In one embodiment, a remote vehicle 106 responds to the retry message 326 with the status of a single remote vehicle 106. For example, even though the first remote vehicle 106A has the statuses of both the second and third remote vehicles 106B, 106C stored onboard the first remote vehicle 106A, the first remote vehicle 106A responds to the retry message 326 with the stored status of the second remote vehicle 106B and not the status of any other remote vehicle 106. The remote vehicles 106 may respond to retry messages 326 or 334 with the status of a designated remote vehicle 106, such as the next remote vehicle 106 along the length of the vehicle consist 102. For example, the first remote vehicle 106A can respond with the status of the second remote vehicle 106B, the second remote vehicle 106B can respond with the status of the third remote vehicle 106C, and so on. Alternatively, the remote vehicles 106A may respond to a retry message 326 with several stored statuses of remote vehicles 106 that are identified by the retry message 326.

After transmitting the repeat message 330 with the status of one or more remote vehicles 106 that are identified in the retry message 326 from the lead vehicle 104, the remote vehicle 106 that transmitted the repeat message 330 may remove (e.g., delete) the status of the remote vehicle 106 identified by the retry message 326 from the onboard memory 412. For example, after the first remote vehicle 106A transmits the repeat message 330 with the stored status of the second remote vehicle 106B, the first remote vehicle 106A may delete the status of the second remote vehicle 106B from the memory 412 of the first remote vehicle 106A.

With respect to the third remote vehicle 106C in the example shown in FIG. 3, the third remote vehicle 106C may receive the retry message 326 or 334 that identifies the third remote vehicle 106C as a missing remote vehicle 106. As a result, the communication unit 410 of the third remote vehicle 106C activates during an activation time period 336 and transmits a reply message 338. As shown by the designation "S3" in FIG. 3, the reply message 338 includes the status of the third remote vehicle 106C.

In the example of FIG. 3, the lead vehicle 104 receives the repeat message 330 from the first remote vehicle 106A that includes the status of the second remote vehicle 106B, as described above. The lead vehicle 104 does not, however, receive the reply message 338 transmitted by the third remote vehicle 106C, as shown by the "X" drawn over the reply message 338. After receiving the repeat message 330 from the first remote vehicle 106A, the communication unit 410 of the lead vehicle 104 may activate during an activation time period 342 and transmit another retry message 340 that includes the identity of the third remote vehicle 106C. The retry message 340 includes the identity of the third remote vehicle 106C because the lead vehicle 104 still does not have the status of the third remote vehicle 106C.

In the illustrated example, the first remote vehicle 106A receives the second retry message 340 and extracts the identity of the third remote vehicle 106C from the retry message 340. The first remote vehicle 106A examines the identities and statuses stored in the memory 412 of the first remote vehicle 106A (as described above), and determines that the first remote vehicle 106A has the status of the third remote vehicle 106C. For example, the communication unit 410 of the first remote vehicle 106A activates during an activation time period 344 and transmits a repeat message 346 to the lead vehicle 104 that includes the status of the third remote vehicle 106C. When the lead vehicle 104 receives the repeat message 346, the lead vehicle 104 has the statuses of the remote vehicles 106A, 106B, 106C.

While the description of the illustrated examples focuses on the first remote vehicle 106A transmitting the statuses of the second and third remote vehicles 106B, 106C in the repeat messages 330, 346 to the lead vehicle 104, the description also may apply to the second, third, or other remote vehicle 106 in the vehicle consist 102. For example, the second remote vehicle 106B may transmit the statuses of the first, third, or other remote vehicle 106 in repeat messages when the second remote vehicle 106B receives retry messages from the lead vehicle 104.

In one embodiment of implementing the method 200 shown in FIGS. 2A and 2B with the system 100, the lead vehicle 104 transmits the command message 306 to the remote vehicles 106. The first remote vehicle 106A receives the command message 306 and transmits the status of the first remote vehicle 106A to the lead vehicle 104 in the reply message 316. The first remote vehicle 106A also repeats the command message 306 by transmitting the command message 314. The second remote vehicle 106B receives the command message 306 and/or 314 and transmits the status of the second remote vehicle 106B to the lead vehicle 104 in the reply message 322. The second remote vehicle 106B also repeats the command message 306 or 314 by transmitting another re-transmitted command message 318. The third remote vehicle 106C receives the command message 306 and/or 314 and/or 318 and transmits the status of the third remote vehicle 106C to the lead vehicle 104 in the reply message 324. The third remote vehicle 106C also can repeat the command message 306 or 314 or 318 by transmitting another re-transmitted command message 320.

One or more of the remote vehicles 106 may receive the reply message 316, 322, 324 sent by one or more other remote vehicles 106. The remote vehicles 106 that receive the reply messages 316, 322, 324 can locally store the identity and associated status included in the reply messages 316, 322, 324. In one embodiment, each remote vehicle 106 may only store the status and identity of designated ones of the remote vehicles 106. For example, a remote vehicle 106 may only store the statuses and identities of those remote vehicles 106 that are downstream of the remote vehicle 106 along a direction of travel of the vehicle consist 102. Alternatively, the remote vehicles 106 may store the statuses and identities of other remote vehicles 106.

In one embodiment, if the lead vehicle 104 does not receive the reply messages 316, 322, 324 from each remote vehicle 106, then the lead vehicle 104 re-transmits the command message (e.g., in the retry message 326, 340). The lead vehicle 104 may delay re-transmission of the command message by at least a designated amount to avoid interfering with the transmission of reply messages 316, 322, 324 by the remote vehicles 106. This delay may be based on the number of remote vehicles 106 from which the lead vehicle 104 has not received a status and identity. For example, the communication unit 410 of the lead vehicle 104 may delay re-transmission of the command message by a time period multiplied or otherwise increased by the number of remote vehicles 106 from which the lead vehicle 104 has not yet received a reply message 316, 322, 324. In one embodiment, the time delay is 512 msec times the number of remote vehicles 106 from which the lead vehicle 104 has not yet received a reply message 316, 322, 324.

The retry message 326 that is transmitted by the communication unit 410 of the lead vehicle 104 may be modified from the previously transmitted command message 306. For example, the retry message 326 may include one or more bits or bytes that are not included in the command message 306 that indicate that the retry message 326 is a retry message and not another command message. Such a bit or byte may be referred to as a "Retry Command/Repeat Status" byte. The remote vehicles 106 that receive the retry message 326 may identify this bit or byte in order to differentiate between new command messages 306 and retry messages 326. This bit or byte (or another bit or byte) in the retry message 326 may include an identifier bit or byte that indicates the remote vehicles 106 from which the lead vehicle 104 has not received reply messages 316, 322, 324.

In one embodiment, as each remote vehicle 106 receives the retry message 326 with the identified missing remote statuses, the receiving remote vehicle 106 transmits the status of the lowest missing remote vehicle 106 from the list of locally stored statuses and identities. By "lowest missing remote vehicle 106," it is meant that the remote vehicle 106 that receives the retry message 326 transmits the status of the remote vehicle 106 that is closest to the receiving remote vehicle 106 along the length of the vehicle consist 102, such as the next remote vehicle 106 located downstream from the receiving remote vehicle 106 along the length of the vehicle consist 102 in the direction of travel of the vehicle consist 102. Alternatively, the receiving remote vehicle 106 may transmit the status of another remote vehicle 106. The remote vehicles 106 may be assigned non-overlapping time slots during which the remote vehicles 106 are to transmit messages to the lead vehicle 104. The remote vehicle 106 that receives the retry message 326 may transmit the status of another remote vehicle 106 in the time slot that is assigned to the receiving remote vehicle 106. Alternatively, the remote vehicle 106 may transmit the status during another time slot.

As each remote vehicle 106 transmits the status of another remote vehicle 106 to the lead vehicle 104, the remote vehicle 106 that transmitted the status will remove the status of the other remote vehicle 106 from the stored list of statuses that is onboard the remote vehicle 106 that transmitted the status.

The communication unit 410 of the lead vehicle 104 may wait between transmissions of command messages 306 and retry messages 326 to receive the reply messages 316, 322, 324 and/or repeat messages 330 sent by the remote vehicles 106. In one embodiment, if the communication unit 410 of the lead vehicle 104 has not received the statuses of all of the remote vehicles 106 in the vehicle consist 102 after transmitting the retry message 326 a number of times that is equivalent to the number of remote vehicles 104 in the vehicle consist 102, then the lead vehicle 104 may cease sending additional retry messages 326. For example, the lead vehicle 104 may send another command message 306 that does not include the "Retry Command /Repeat Status" bit or byte. The remote vehicles 106 that receive this new command message 306 can then respond by transmitting a reply message 316, 322, 324 with the status of the remote vehicles 106 and may begin updating the locally stored list of statuses of other remote vehicles 106 (based on the reply messages 316, 322, 324 received by the other remote vehicles 106).

During the transmission of retry messages 326 to the remote vehicles 106, the directives sent to the remote vehicles 106 from the lead vehicle 104 may need to change. For example, the tractive efforts, braking efforts, speed, power output, or the like, that is automatically or manually demanded from the remote vehicles 106 may change. The lead vehicle 104 can transmit another command message 306 that does not include the "Retry Command/Repeat Status" bit or byte. The remote vehicles 106 that receive this new command message 306 can then respond by transmitting a reply message 316, 322, 324 with the status of the remote vehicles 106 and may begin updating the locally stored list of statuses of other remote vehicles 106 (based on the reply messages 316, 322, 324 received by the other remote vehicles 106).

Once the lead vehicle 104 has received the statuses of all of the remote vehicles 106, in one embodiment, the lead vehicle 104 can return to a normal periodic transmission of the command messages 306. For example, if, prior to the transmission of the retry messages 326, the lead vehicle 104 was transmitting a new command message 306 (with the same or different directives for the remote vehicles 106) every 20 seconds (or other time period), then the lead vehicle 104 may return to this periodic transmission of command messages 306 after receiving the statuses of all of the remote vehicles 10 in one embodiment.

Figure 4:
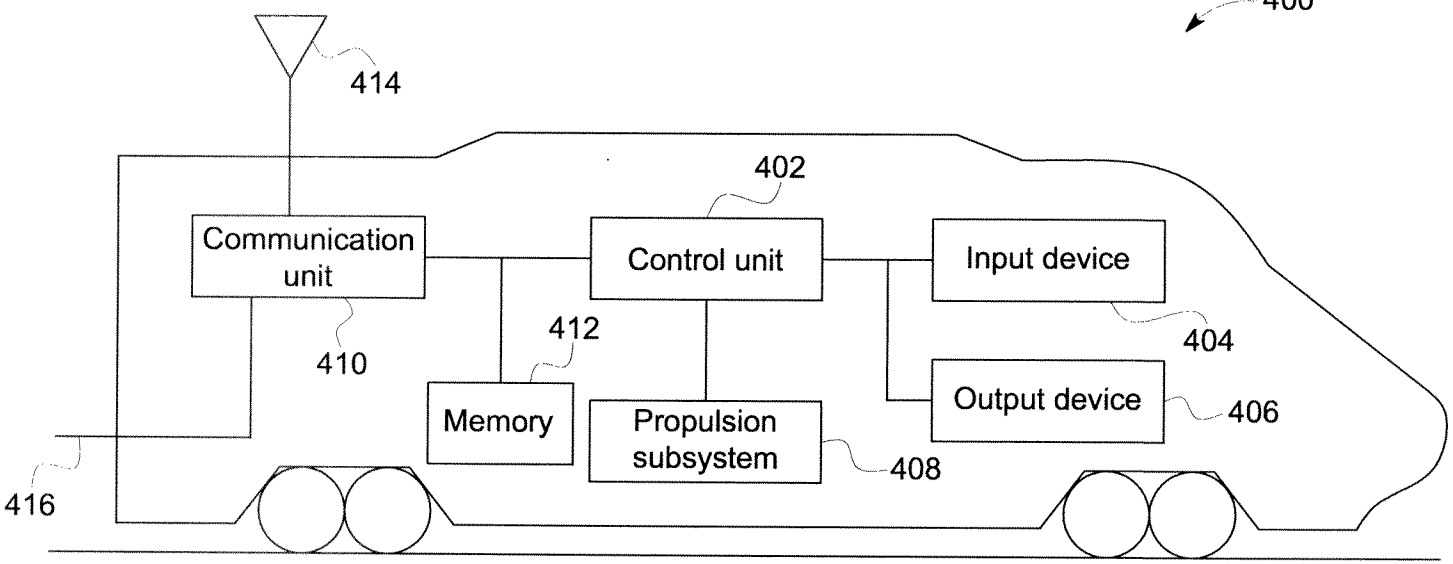
FIG. 4 is a schematic diagram of a powered vehicle in accordance with one embodiment.

FIG. 4 is a schematic diagram of a powered vehicle 400 in accordance with one embodiment. The powered vehicle 400 may represent one or more of the powered vehicles 104, 106 shown in FIG. 1. The powered vehicle 400 includes a control unit 402 that controls operations of the powered vehicle 400. The control unit 402 is connected with an input device 404 and an output device 406. The control unit 402 can receive manual input from an operator of the powered vehicle 400 through the input device 404, such as a touchscreen, keyboard, electronic mouse, microphone, or the like. For example, the control unit 402 can receive manually input changes to the tractive effort, braking effort, speed, power output, and the like, from the input device 404. The control unit 402 can present information to the operator using the output device 406, which can represent a display screen (e.g., touchscreen or other screen), speakers, printer, or the like. For example, the control unit 402 can present the identities and statuses of the remote vehicles 106, identities of the missing remote vehicles 106 (e.g., those remote vehicles 106 from which the lead vehicle 104 has not received the status), contents of one or more command messages, retry messages, reply messages, repeat messages, or the like.

The control unit 402 is connected with a propulsion subsystem 408 of the powered vehicle 400. The propulsion subsystem 408 provides tractive effort and/or braking effort of the powered vehicle 400. The propulsion subsystem 408 may include or represent one or more engines, motors, alternators, generators, brakes, batteries, turbines, and the like, that operate to propel the powered vehicle 400 under the manual or autonomous control that is implemented by the control unit 400. For example, the control unit 400 can generate control signals autonomously or based on manual input that is used to direct operations of the propulsion subsystem 408.

The control unit 402 also is connected with the communication unit 410 and the memory 412 of the powered vehicle 400. The memory 412 can represent an onboard device that electronically and/or magnetically stores data. For example, the memory 412 may represent a computer hard drive, random access memory, read-only memory, dynamic random access memory, an optical drive, or the like.

The communication unit 410 includes or represents hardware and/or software that is used to communicate with other powered vehicles 400 in the vehicle consist 102. For example, the communication unit 410 may include a transceiver 414 and associated circuitry for wirelessly communicating (e.g., transmitting and/or receiving) command messages, reply messages, retry messages, and/or repeat messages, as described above. Additionally or alternatively, the communication unit 410 include circuitry for communicating command messages, reply messages, retry messages, and/or repeat messages over a wired connection 416, such as an electric multiple unit (eMU) line of the vehicle consist 102 or another conductive pathway between or among the powered vehicles 104, 106, 400 in the vehicle consist 102. The control unit 402 may control the communication unit 410 by activating the communication unit 410 (as described above). The communication unit 410 can examine the messages that are received by the powered unit 400 as described above. For example, the communication unit 410 of a remote vehicle 106 can examine received command messages to determine the directive sent by the lead vehicle 104. The directive can be conveyed to the control unit 402, which then implements the directive by creating control signals that are communicated to the propulsion subsystem 408 for autonomous control or by presenting the directive to the operator on the output device 406 for manual implementation of the directive.

The communication unit 410 of a remote vehicle 106 can examine received reply messages sent by other remote vehicles 106 to determine the identities and statuses of the other remote vehicles 106, as described above. The communication unit 410 can store these received identities and statuses in the memory 412. The communication unit 410 of a remote vehicle 106 can receive and examine retry messages sent by the lead vehicle 104 and determine if the memory 412 has the statuses stored of the missing remote vehicles 106 that are identified in the retry messages, as described above. The communication unit 410 can transmit the repeat messages to provide the lead vehicle 104 with the stored statuses. The communication unit 410 of the remote vehicles 104 also can re-transmit the command messages received from the lead vehicle 104, as described above.

The communication unit 410 of the lead vehicle 104 can transmit the command messages and determine which remote vehicles 106 have not responded with the statuses of the remote vehicles 106. The communication unit 410 can then transmit the retry messages that include the identities of the remote vehicles 106 having missing statues, as described above.

In one embodiment, a method (e.g., for communicating in a vehicle consist) includes transmitting a command message from a lead vehicle in the vehicle consist having two or more remote vehicles coupled with the lead vehicle. The command message includes a directive for controlling one or more operations of the remote vehicles. The method also includes receiving the command message at the remote vehicles and transmitting reply messages to the lead vehicle from the remote vehicles. The reply messages include statuses of the remote vehicles that transmitted the reply messages. The method further includes receiving the status of a first remote vehicle of the two or more remote vehicles at the lead vehicle and receiving the status of a second remote vehicle of the two or more remote vehicles at the first remote vehicle. The status of the second remote vehicle is not received at the lead vehicle. The method also includes storing the status of the second remote vehicle at the first remote vehicle and transmitting a retry message from the lead vehicle to the remote vehicles. The retry message includes an identity of the second remote vehicle. The method further includes receiving the retry message at the first remote vehicle and transmitting a repeat message from the first remote vehicle to the lead vehicle in response to receiving the retry message. The repeat message includes the status of the second remote vehicle.

In one aspect, storing the status of the second remote vehicle includes recording the status in a memory disposed onboard the first remote vehicle.

In one aspect, the retry message that is transmitted from the lead vehicle additionally includes the directive previously transmitted in the command message.

In one aspect, the method also includes re-transmitting the command message from the first remote vehicle and the second remote vehicle responsive to receiving the command message from the lead vehicle at the first remote vehicle and the second remote vehicle.

In one aspect, the directive that is included in the command message directs the remote vehicles to change at least one of moving speeds of the remote vehicles, power outputs of the remote vehicles, tractive efforts provided by propulsion subsystems of the remote vehicles, or braking efforts provided by the propulsion subsystems of the remote vehicles.

In one aspect, the statuses that are included in the reply messages represent at least one of current operational states of the remote vehicles, currently implemented tractive efforts provided by the remote vehicles, currently implemented braking efforts provided by the remote vehicles, or operational errors of the remote vehicles.

In one aspect, each of the remote vehicles is assigned a time slot during which the remote vehicle communicates with the lead vehicle. Transmitting the repeat message from the first remote vehicle that includes the status of the second remote vehicle can occur during the time slot assigned to the first remote vehicle. The assigned time slots may be non-overlapping time periods.

In another embodiment, another method (e.g., for communicating in a vehicle consist) includes transmitting a command message from a lead vehicle in a vehicle consist having two or more remote vehicles coupled with the lead vehicle. The command message includes a directive for controlling one or more operations of the remote vehicles. The method also includes receiving a first reply message from a first remote vehicle of the remote vehicles in the vehicle consist. The first reply message is transmitted by the first remote vehicle responsive to the command message and including a status of the first remote vehicle. A second reply message is not received from a second remote vehicle of the remote vehicles in the vehicle consist responsive to the command message. The method further includes transmitting a retry message from the lead vehicle to the remote vehicles. The retry message includes an identity of the second remote vehicle. The method also includes receiving a first repeat message from the first remote vehicle in response to the retry message. The first repeat message includes the status of the second remote vehicle.

In another embodiment, another method (e.g., for communicating in a vehicle consist) includes transmitting a command message from a lead vehicle in a vehicle consist having two or more remote vehicles coupled with the lead vehicle. The command message includes a directive for controlling one or more operations of the remote vehicles. The method also includes receiving a first reply message from a first remote vehicle of the two or more remote vehicles in the vehicle consist responsive to the command message. The first reply message includes a status of the first remote vehicle. If a second reply message is not received from a second remote vehicle of the remote vehicles responsive to the command message, then the method also includes transmitting a retry message from the lead vehicle to the remote vehicles (where the retry message includes an identity of the second remote vehicle) and receiving a first repeat message from the first remote vehicle in response to the retry message (where the first repeat message includes the status of the second remote vehicle).

In one aspect, transmitting the retry message is repeated until the status of the second remote vehicle is received or until the retry message is re-transmitted a designated number of times.

In one aspect, additional reply messages are not received from a missing set of two or more of the remote vehicles that includes the second remote vehicle, and transmitting the retry message includes transmitting the retry message with identities of each of the remote vehicles in the missing set of the remote vehicles.

In one aspect, receiving the first repeat message includes receiving at least one second repeat message from one or more of the remote vehicles. The second repeat message includes the status of one or more of the remote vehicles in the missing set of the remote vehicles.

In one aspect, transmitting the retry message is repeated until the statuses of the remote vehicles in the missing set of remote vehicles are received in the first repeat message or the at least one second repeat message.

In one aspect, the method also includes, responsive to receiving the statuses of one or more of the remote vehicles in the missing set of remote vehicles, removing the identities of the one or more of the remote vehicles for which the identities are received and transmitting the retry message without the identities that are removed.

In one aspect, the directive that is included in the command message directs the remote vehicles to change at least one of moving speeds of the remote vehicles, power outputs of the remote vehicles, tractive efforts provided by propulsion subsystems of the remote vehicles, or braking efforts provided by the propulsion subsystems of the remote vehicles.

In one aspect, the status that is included in the second reply message represents at least one of a current operational state of the second remote vehicle, a currently implemented tractive effort provided by the second remote vehicle, a currently implemented braking effort provided by the second remote vehicle, or an operational error of the second remote vehicle.

In one aspect, each of the remote vehicles is assigned a time slot during which the remote vehicle communicates with the lead vehicle. The first repeat message that is received from the first remote vehicle and that includes the status of the second remote vehicle is transmitted during the time slot assigned to the first remote vehicle. The time slots assigned to the remote vehicles may be non-overlapping time periods.

In another embodiment, a method (e.g., for communicating in a vehicle consist) includes receiving a command message from a lead vehicle at a first remote vehicle in the vehicle consist having the lead vehicle, the first remote vehicle, and a second remote vehicle coupled with one another. The command message includes a directive from the lead vehicle for controlling one or more operations of the first remote vehicle and the second remote vehicle. The method also includes transmitting a reply message to the lead vehicle from the first remote vehicle. The reply message includes a first status of the first remote vehicle. The method also includes receiving a second status of the second remote vehicle at the first remote vehicle, storing the second status at the first remote vehicle, and receiving a first retry message transmitted from the lead vehicle at the first remote vehicle. The first retry message includes an identity of the second remote vehicle. The method also includes transmitting a first repeat message from the first remote vehicle to the lead vehicle in response to receiving the first retry message. The first repeat message includes the second status of the second remote vehicle that is stored at the first remote vehicle.

In one aspect, the second status of the second remote vehicle is not received at the lead vehicle prior to receiving the first retry message from the lead vehicle.

In one aspect, storing the second status includes recording the second status in a memory disposed onboard the first remote vehicle.

In one aspect, the method also includes re-transmitting the command message from the first remote vehicle responsive to receiving the command message from the lead vehicle at the first remote vehicle.

In one aspect, the method also includes removing the second status from storage at the first remote vehicle responsive to transmitting the first repeat message that includes the second status.

In one aspect, receiving the second status includes receiving one or more additional statuses of one or more additional remote vehicles in the vehicle consist and storing the second status includes storing the one or more additional statuses at the first remote vehicle.

In one aspect, the method also includes receiving at least one second retry message including the identity of the one or more additional remote vehicles and transmitting at least one second repeat message that includes the one or more additional statues of the one or more additional remote vehicles responsive to receiving the at least one second retry message.

In one aspect, the first remote vehicle and the second remote vehicle are assigned respective time slots to communicate with the lead vehicle. Transmitting the first repeat message that includes the second status of the second remote vehicle from the first remote vehicle can occur during the time period assigned to the first remote vehicle. The time slots assigned to the first and second remote vehicles may represent non-overlapping time periods.

In one embodiment, a system (e.g., a communication system) includes a lead communication unit, first and second remote communication units, and a memory. The lead communication unit is configured to be disposed onboard a lead vehicle in a vehicle consist having at least first and second remote vehicles coupled with the lead vehicle. The lead communication unit also is configured to transmit a command message to the remote vehicles for controlling one or more operations of the first and second remote vehicles. The first and second remote communication units are configured to be disposed onboard the first and second remote vehicles of the vehicle consist, respectively. The first and second remote communication units are configured to receive the command message and to broadcast first and second reply messages to the lead vehicle that includes first and second statuses of the first and second remote vehicles, respectively. The lead communication unit is configured to receive the first status of the first remote vehicle and the first remote communication unit is configured to receive the second status of the second remote vehicle. The memory is configured to be disposed onboard the first remote vehicle and to store the second status of the second remote vehicle. The lead communication unit is configured to transmit a retry message that includes an identity of the second remote vehicle when the second reply message to the command message is not received at the lead vehicle from the second remote vehicle. The first remote communication unit is configured to receive the retry message and to transmit a repeat message to the lead vehicle in response to receiving the retry message. The repeat message includes the status of the second remote vehicle.

In one aspect, the retry message that is transmitted by the lead communication unit includes the identity of the second remote vehicle and a directive previously transmitted in the command message.

In one aspect, the first remote communication unit is configured to re-transmit the command message to the second remote vehicle responsive to receiving the command message from the lead vehicle.

In one aspect, the command message directs the first and second remote vehicles to change at least one of moving speeds of the first and second remote vehicles, power outputs of the first and second remote vehicles, tractive efforts provided by propulsion subsystems of the first and second remote vehicles, or braking efforts provided by the propulsion subsystems of the first and second remote vehicles.

In one another embodiment, a system (e.g., a communication system) includes a lead communication unit and a memory. The lead communication unit is configured to be disposed onboard a lead vehicle in a vehicle consist having two or more remote vehicles coupled with the lead vehicle. The lead communication unit also is configured to transmit a command message having a directive for controlling one or more operations of the remote vehicles and to receive a reply message from a first remote vehicle of the remote vehicles in the vehicle consist. The reply message transmitted by the first remote vehicle is responsive to the command message and including a status of the first remote vehicle. The memory is configured to be disposed onboard the lead vehicle and to store the status of the first remote vehicle. When a second reply message is not received by the lead communication unit from a second remote vehicle of the remote vehicles in the vehicle consist responsive to transmission of the command message, the lead communication unit is configured to transmit a retry message from the lead vehicle to the remote vehicles that includes an identity of the second remote vehicle and to receive a first repeat message from the first remote vehicle in response to the retry message. The first repeat message includes the status of the second remote vehicle.

In one aspect, when a reply message is not received from a missing set of two or more of the remote vehicles that includes the second remote vehicle responsive to the transmission of the command message, the lead communication unit is configured to transmit the retry message with identities of each of the remote vehicles in the missing set of the remote vehicles and the memory is configured to store the identities of the remote vehicles in the missing set.

In one aspect, the lead communication unit is configured to receive at least a second repeat message from one or more of the remote vehicles. The second repeat message includes the status of one or more of the remote vehicles in the missing set of the remote vehicles. The memory is configured to remove the identities of the remote vehicles in the missing set for which the statuses are received.

In another embodiment, a system (e.g., a communication system) includes a first remote communication unit and a memory. The first remote communication unit is configured to be disposed onboard a first remote vehicle of a vehicle consist having a lead vehicle and at least one second remote vehicle coupled with the first remote vehicle. The first remote communication unit is configured to receive a command message from the lead vehicle for controlling one or more operations of the first remote vehicle and the at least one second remote vehicle and to transmit a reply message to the lead vehicle from the first remote vehicle that includes a first status of the first remote vehicle. The memory is configured to be disposed onboard the first remote vehicle. The first remote communication unit is configured to receive a second status of the at least one second remote vehicle that is transmitted by a second remote communication unit responsive to the command message and the memory is configured to store the second status at the first remote vehicle. The first remote communication unit also is configured to receive a first retry message from the lead vehicle that includes an identity of the at least one second remote vehicle and to transmit a first repeat message to the lead vehicle in response to receiving the first retry message. The first repeat message includes the second status of the at least one second remote vehicle that is stored at the first remote vehicle.

In one aspect, the memory is configured to remove the second status from storage at the first remote vehicle responsive to transmitting the first repeat message that includes the second status.

In one aspect, the first remote communication unit is configured to receive one or more additional statuses of one or more additional remote vehicles in the vehicle consist and the memory is configured to store the one or more additional statuses at the first remote vehicle.

In one aspect, the first remote communication unit is configured to receive at least a second retry message including the identity of the one or more additional remote vehicles, and the first remote communication unit is configured to transmit at least a second repeat message that includes the one or more additional statues of the one or more additional remote vehicles responsive to receiving the at least a second retry message.

It is to be understood that the above description is intended to be illustrative, and not restrictive. For example, the above-described embodiments (and/or aspects thereof) may be used in combination with each other. In addition, many modifications may be made to adapt a particular situation or material to the teachings of the inventive subject matter without departing from its scope. While the dimensions and types of materials described herein are intended to define the parameters of the inventive subject matter, they are by no means limiting and are exemplary embodiments. Many other embodiments will be apparent to one of ordinary skill in the art upon reviewing the above description. The scope of the inventive subject matter should, therefore, be determined with reference to the appended claims, along with the full scope of equivalents to which such claims are entitled. In the appended claims, the terms "including" and "in which" are used as the plain-English equivalents of the respective terms "comprising" and "wherein." Moreover, in the following claims, the terms "first," "second," and "third," etc. are used merely as labels, and are not intended to impose numerical requirements on their objects. Further, the limitations of the following claims are not written in means-plus-function format and are not intended to be interpreted based on 35 U.S.C. §112, sixth paragraph, unless and until such claim limitations expressly use the phrase "means for" followed by a statement of function void of further structure.

This written description uses examples to disclose several embodiments of the inventive subject matter and also to enable one of ordinary skill in the art to practice the embodiments of inventive subject matter, including making and using any devices or systems and performing any incorporated methods. The patentable scope of the inventive subject matter is defined by the claims, and may include other examples that occur to one of ordinary skill in the art. Such other examples are intended to be within the scope of the claims if they have structural elements that do not differ from the literal language of the claims, or if they include equivalent structural elements with insubstantial differences from the literal languages of the claims.

The foregoing description of certain embodiments of the present inventive subject matter will be better understood when read in conjunction with the appended drawings. To the extent that the figures illustrate diagrams of the functional blocks of various embodiments, the functional blocks are not necessarily indicative of the division between hardware circuitry. Thus, for example, one or more of the functional blocks (for example, processors or memories) may be implemented in a single piece of hardware (for example, a general purpose signal processor, microcontroller, random access memory, hard disk, and the like). Similarly, the programs may be stand alone programs, may be incorporated as subroutines in an operating system, may be functions in an installed software package, and the like. The various embodiments are not limited to the arrangements and instrumentality shown in the drawings.

As used herein, an element or step recited in the singular and proceeded with the word "a" or "an" should be understood as not excluding plural of said elements or steps, unless such exclusion is explicitly stated. Furthermore, references to "one embodiment" of the present inventive subject matter are not intended to be interpreted as excluding the existence of additional embodiments that also incorporate the recited features. Moreover, unless explicitly stated to the contrary, embodiments "comprising," "including," or "having" an element or a plurality of elements having a particular property may include additional such elements not having that property.

The invention claimed is:

1. A method comprising:

communicating, with a lead transceiver onboard a lead vehicle, a command message from the lead vehicle in a vehicle consist having two or more remote vehicles coupled with the lead vehicle, the command message including a directive for controlling one or more operations of the remote vehicles;

receiving, with remote transceivers onboard the remote vehicles, the command message and communicating, with the transceivers onboard the remote vehicles, reply messages to the lead vehicle from the remote vehicles, the reply messages including statuses of the remote vehicles that communicated the reply messages;

receiving, with the lead transceiver, the reply message sent from a first remote vehicle of the two or more remote vehicles at the lead vehicle and receiving, with a first remote transceiver of the remote transceivers, the reply message sent from a second remote vehicle of the two or more remote vehicles at the first remote vehicle, wherein the reply message sent from the second remote vehicle is not received by the lead transceiver at the lead vehicle;

storing the status of the second remote vehicle at the first remote vehicle by recording the status in a memory disposed onboard the first remote vehicle;

communicating, with the lead transceiver, a retry message from the lead vehicle to the remote vehicles, the retry message including an identity of the second remote vehicle; and receiving, with the first remote transceiver, the retry message at the first remote vehicle and communicating, with the first remote transceiver, a repeat message from the first remote vehicle to the lead vehicle in response to receiving the retry message, the repeat message including the status of the second remote vehicle which was not previously received by the lead transceiver of the lead vehicle in response to one or more of the command message or the retry message. the repeat message including the status of the second remote vehicle only if the status of the second remote vehicle is previously received by the first remote transceiver onboard the first remote vehicle.

2. The method of claim 1, wherein the retry message that is communicated from the lead vehicle additionally includes the directive previously communicated in the command message.

3. The method of claim 1, further comprising re-communicating the command message from the first remote vehicle and the second remote vehicle responsive to receiving the command message from the lead vehicle at the first remote vehicle and the second remote vehicle.

4. The method of claim 1, wherein the directive that is included in the command message directs the remote vehicles to change at least one of moving speeds of the remote vehicles, power outputs of the remote vehicles, tractive efforts provided by propulsion subsystems of the remote vehicles, or braking efforts provided by the propulsion subsystems of the remote vehicles.

5. The method of claim 1, wherein the statuses that are included in the reply messages represent at least one of current operational states of the remote vehicles, currently implemented tractive efforts provided by the remote vehicles, currently implemented braking efforts provided by the remote vehicles, or operational errors of the remote vehicles.

6. The method of claim 1, wherein each of the remote vehicles is assigned a time slot during which the remote vehicle communicates with the lead vehicle, and wherein communicating the repeat message from the first remote vehicle that includes the status of the second remote vehicle occurs during the time slot assigned to the first remote vehicle.

7. A method comprising:

communicating, with a lead transceiver onboard a lead vehicle in a vehicle consist having two or more remote vehicles coupled with the lead vehicle, a command message that includes a directive for controlling one or more operations of the remote vehicles;

receiving, with the lead transceiver, a first reply message from a first remote vehicle of the two or more remote vehicles in the vehicle consist responsive to the command message, the first reply message including a status of the first remote vehicle; and if a second reply message is not received from a second remote transceiver onboard a second remote vehicle of the remote vehicles responsive to the command message:

communicating, with the lead transceiver., a retry message from the lead vehicle to the remote vehicles, the retry message including an identity of the second remote vehicle; and receiving, with the lead transceiver, a first repeat message from a first remote transceiver onboard the first remote vehicle in response to the retry message, the first repeat message including the status of the second remote vehicle which was not previously received by the lead transceiver of the lead vehicle in response to one or more of the command message or the retry message, the first repeat message including the status of the second remote vehicle only if the status of the second remote vehicle is received at the first remote vehicle.

8. The method of claim 7, wherein communicating the retry message is repeated until the status of the second remote vehicle is received or until the retry message is re-communicated a designated number of times.

9. The method of claim 7, wherein additional reply messages are not received from a missing set of two or more of the remote vehicles that includes the second remote vehicle, and communicating the retry message includes communicating the retry message with identities of each of the remote vehicles in the missing set of the remote vehicles.

10. The method of claim 9, wherein receiving the first repeat message includes receiving at least one second repeat message from one or more of the remote vehicles, the second repeat message including the status of one or more of the remote vehicles in the missing set of the remote vehicles.

11. The method of claim 10, wherein communicating the retry message is repeated until the statuses of the remote vehicles in the missing set of remote vehicles are received in the first repeat message or the at least one second repeat message.

12. The method of claim 11, further comprising, responsive to receiving the statuses of one or more of the remote vehicles in the missing set of remote vehicles, removing the identities of the one or more of the remote vehicles for which the identities are received, and communicating the retry message without the identities that are removed.

13. The method of claim 9, wherein the directive that is included in the command message directs the remote vehicles to change at least one of moving speeds of the remote vehicles, power outputs of the remote vehicles, tractive efforts provided by propulsion subsystems of the remote vehicles, or braking efforts provided by the propulsion subsystems of the remote vehicles.

14. The method of claim 7, wherein the status that is included in the second reply message represents at least one of a current operational state of the second remote vehicle, a currently implemented tractive effort provided by the second remote vehicle, a currently implemented braking effort provided by the second remote vehicle, or an operational error of the second remote vehicle.

15. The method of claim 7, wherein each of the remote vehicles is assigned a time slot during which the remote vehicle communicates with the lead vehicle, and wherein the first repeat message that is received from the first remote vehicle and that includes the status of the second remote vehicle is communicated during the time slot assigned to the first remote vehicle.

16. A method comprising:

receiving, with a remote transceiver onboard a first remote vehicle in a vehicle consist having a lead vehicle, the first remote vehicle, and a second remote vehicle coupled with one another, a command message from the lead vehicle that includes a directive from the lead vehicle for controlling one or more operations of the first remote vehicle and the second remote vehicle;

communicating, with the remote transceiver, a reply message to the lead vehicle from the first remote vehicle, the reply message including a first status of the first remote vehicle;

receiving, with the remote transceiver., a second status of the second remote vehicle at the first remote vehicle;

storing the second status of the second remote vehicle in a memory onboard the first remote vehicle;

receiving, with the remote transceiver, a first retry message communicated from the lead vehicle at the first remote vehicle, the first retry message including an identity of the second remote vehicle; and communicating, with the remote transceiver, a first repeat message from the first remote vehicle to the lead vehicle in response to receiving the first retry message, the first repeat message including the second status of the second remote vehicle that is stored at the first remote vehicle which was not previously received by the lead vehicle in response to one or more of the command message or the first retry message, the first repeat message including the status of the second remote vehicle only if the second status of the second remote vehicle is previously received by the remote transceiver onboard the first remote vehicle.

17. The method of claim 16, wherein the second status of the second remote vehicle is not received at the lead vehicle prior to receiving the first retry message from the lead vehicle.

18. The method of claim 16, further comprising re-communicating the command message from the first remote vehicle responsive to receiving the command message from the lead vehicle at the first remote vehicle.

19. The method of claim 16, further comprising removing the second status from storage at the first remote vehicle responsive to communicating the first repeat message that includes the second status.

20. The method of claim 16, wherein receiving the second status includes receiving one or more additional statuses of one or more additional remote vehicles in the vehicle consist and storing the second status includes storing the one or more additional statuses at the first remote vehicle.

21. The method of claim 20, further comprising receiving at least one second retry message including the identity of the one or more additional remote vehicles and communicating at least one second repeat message that includes the one or more additional statues of the one or more additional remote vehicles responsive to receiving the at least one second retry message.

22. The method of claim 16, wherein the first remote vehicle and the second remote vehicle are assigned respective time slots to communicate with the lead vehicle, and wherein communicating the first repeat message that includes the second status of the second remote vehicle from the first remote vehicle occurs during the time period assigned to the first remote vehicle.

23. A system comprising:

a lead communication unit configured to be disposed onboard a lead vehicle in a vehicle consist having at least first and second remote vehicles coupled with the lead vehicle, the lead communication unit configured to communicate a command message to the remote vehicles for controlling one or more operations of the first and second remote vehicles; and first and second remote communication units configured to be disposed onboard the first and second remote vehicles of the vehicle consist, respectively, the first and second remote communication units configured to receive the command message and to broadcast first and second reply messages to the lead vehicle that include first and second statuses of the first and second remote vehicles, respectively, wherein the lead communication unit is configured to receive the first status of the first remote vehicle and the first remote communication unit is configured to receive the second status of the second remote vehicle, wherein the lead communication unit is configured to communicate a retry message that includes an identity of the second remote vehicle responsive to the second reply message to the command message not being received at the lead vehicle from the second remote vehicle, and wherein the first remote communication unit is configured to receive the retry message and to communicate a repeat message to the lead vehicle in response to receiving the retry message, the repeat message including the status of the second remote vehicle which was not previously received by the lead communication unit in response to one or more of the command message or the retry message, the repeat message including the status of the second remote vehicle only if the status of the second remote vehicle is previously received by the first remote communication unit.

24. The system of claim 23, wherein the retry message that is communicated by the lead communication unit includes the identity of the second remote vehicle and a directive previously communicated in the command message.

25. The system of claim 23, wherein the first remote communication unit is configured to re-communicate the command message to the second remote vehicle responsive to receiving the command message from the lead vehicle.

26. The system of claim 23, wherein the command message directs the first and second remote vehicles to change at least one of moving speeds of the first and second remote vehicles, power outputs of the first and second remote vehicles, tractive efforts provided by propulsion subsystems of the first and second remote vehicles, or braking efforts provided by the propulsion subsystems of the first and second remote vehicles.

27. A system comprising:

a lead communication unit configured to be disposed onboard a lead vehicle in a vehicle consist having two or more remote vehicles coupled with the lead vehicle, the lead communication unit also configured to communicate a command message having a directive for controlling one or more operations of the remote vehicles and to receive a first reply message from a first remote vehicle of the remote vehicles in the vehicle consist, the first reply message communicated by the first remote vehicle responsive to the command message and including a status of the first remote vehicle, wherein, responsive to a second reply message not being received by the lead communication unit from a second remote vehicle of the remote vehicles in the vehicle consist responsive to communication of the command message, the lead communication unit is configured to communicate a retry message from the lead vehicle to the remote vehicles that includes an identity of the second remote vehicle and to receive a first repeat message from the first remote vehicle in response to the retry message, the first repeat message including the status of the second remote vehicle which was not previously received by the lead communication unit in response to one or more of the command message or the retry message, the first repeat message including the status of the second remote vehicle only if the status of the second remote vehicle is previously received by the first remote vehicle.

28. The system of claim 27, wherein, responsive to a reply message not being received from a missing set of two or more of the remote vehicles that includes the second remote vehicle, the lead communication unit is configured to communicate the retry message with identities of each of the remote vehicles in the missing set of the remote vehicles.

29. The system of claim 28, wherein the lead communication unit is configured to receive at least a second repeat message from one or more of the remote vehicles, the second repeat message including the status of one or more of the remote vehicles in the missing set of the remote vehicles.

30. A system comprising:

a first remote communication unit configured to be disposed onboard a first remote vehicle of a vehicle consist having a lead vehicle and at least one second remote vehicle coupled with the first remote vehicle, the first remote communication unit configured to receive a command message from the lead vehicle for controlling one or more operations of the first remote vehicle and the at least one second remote vehicle and to communicate a reply message to the lead vehicle from the first remote vehicle that includes a first status of the first remote vehicle, wherein the first remote communication unit is configured to receive a second status of the at least one second remote vehicle that is communicated by a second remote communication unit responsive to the command message, and wherein the first remote communication unit also is configured to receive a first retry message from the lead vehicle that includes an identity of the at least one second remote vehicle and to communicate a first repeat message to the lead vehicle in response to receiving the first retry message, the first repeat message including the second status of the at least one second remote vehicle that is stored at the first remote vehicle and which was not previously received by the lead vehicle in response to one or more of the command message or the first retry message, the first repeat message including the second status of the at least one second remote vehicle only if the second status was previously received by the first remote communication unit.

31. The system of claim 30, wherein the first remote communication unit is configured to remove the second status from storage in a memory of the first remote vehicle responsive to communicating the first repeat message that includes the second status.

32. The system of claim 30, wherein the first remote communication unit is configured to receive one or more additional statuses of one or more additional remote vehicles in the vehicle consist.

33. The system of claim 32, wherein the first remote communication unit is configured to receive at least a second retry message including the identity of the one or more additional remote vehicles, and the first remote communication unit is configured to communicate at least a second repeat message that includes the one or more additional statues of the one or more additional remote vehicles responsive to receiving the at least a second retry message.

* * * * *